United States Patent [19]

Dickson

[11] Patent Number: 4,642,947

[45] Date of Patent: Feb. 17, 1987

[54] OPERABLE WALL

[75] Inventor: Wesley B. Dickson, Brea, Calif.

[73] Assignee: Advanced Equipment Corporation, Fullerton, Calif.

[21] Appl. No.: 768,505

[22] Filed: Aug. 21, 1985

[51] Int. Cl.[4] ..... E05D 15/06

[52] U.S. Cl. ..... 52/64; 160/196 R; 49/127; 49/130; 49/409

[58] Field of Search ..... 160/200, 196 R, 188; 49/125, 127, 409, 207, 130; 52/64, 71

[56] References Cited

U.S. PATENT DOCUMENTS

| | | | |
|---|---|---|---|
| 2,929,445 | 3/1960 | Haws | 160/188 X |
| 3,052,000 | 9/1962 | Ferrett | 49/409 X |
| 3,341,985 | 9/1967 | Haws et al. | 52/64 X |
| 3,577,679 | 5/1971 | Petterborg | 49/127 |
| 3,984,930 | 10/1976 | Booland | 52/64 X |
| 4,569,164 | 2/1986 | Dickson | 49/127 X |

FOREIGN PATENT DOCUMENTS

| | | | |
|---|---|---|---|
| 2653328 | 12/1977 | Fed. Rep. of Germany | 49/127 |

*Primary Examiner*—Ramon S. Britts
*Assistant Examiner*—David M. Purol
*Attorney, Agent, or Firm*—Edward D. O'Brian

[57] ABSTRACT

An operable wall system having a primary track and several storage tracks intersecting said primary track can be improved by the use of rotary switches at the intersections of the primary and storage tracks and by the use of a positioning structure carrying holders capable of being actuated so as to engage and disengage wall sections or panels being moved between said primary and said storage tracks. When such an operative wall structure is employed to move a wall section or panel on to the primary track from the storage tracks the panel to be moved is engaged by the holders and then these holders are moved through the movement of the positioning structure so as to place the section or panel being moved on to the switches. The holders are then disengaged from the panel or section and the switches are manipulated so as to allow the panel to be moved along the primary track. In storing panels the reverse of this series of operations is employed.

7 Claims, 6 Drawing Figures

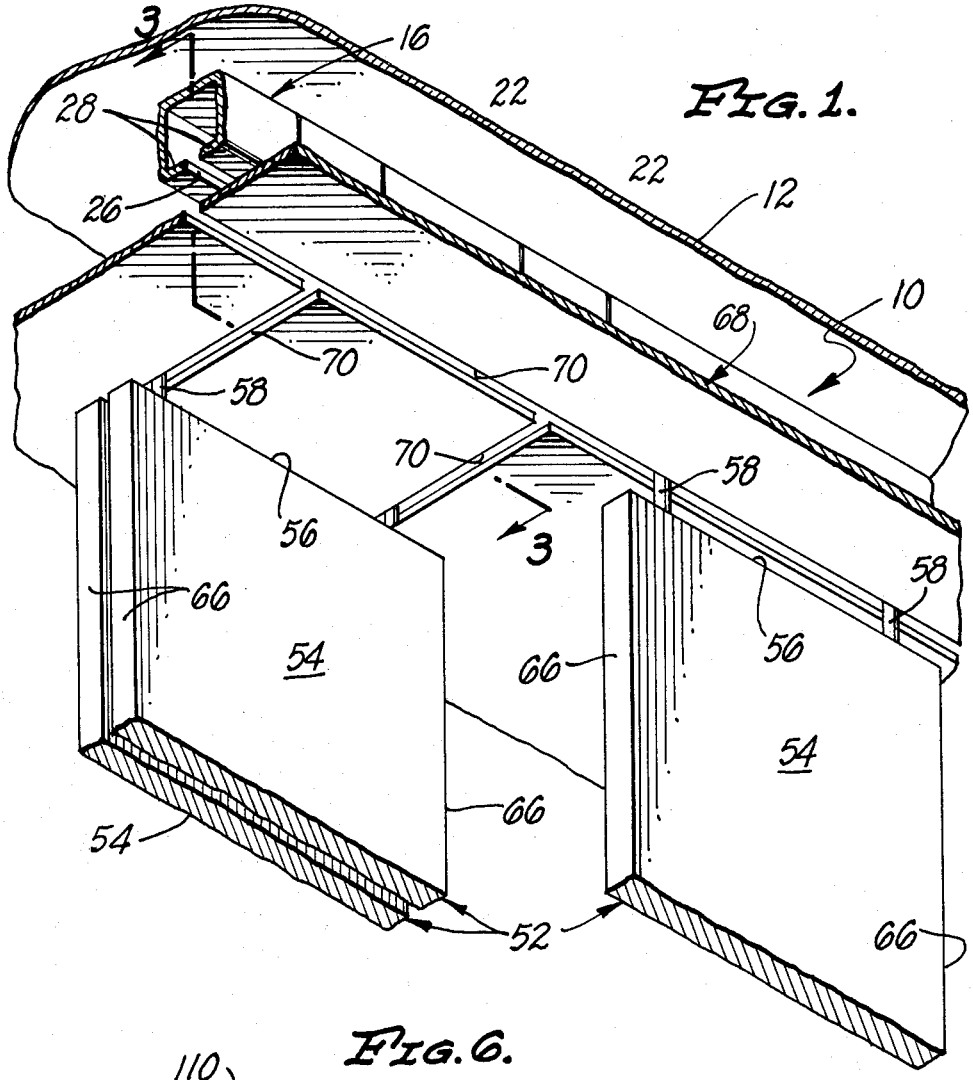
FIG. 1.
FIG. 6.
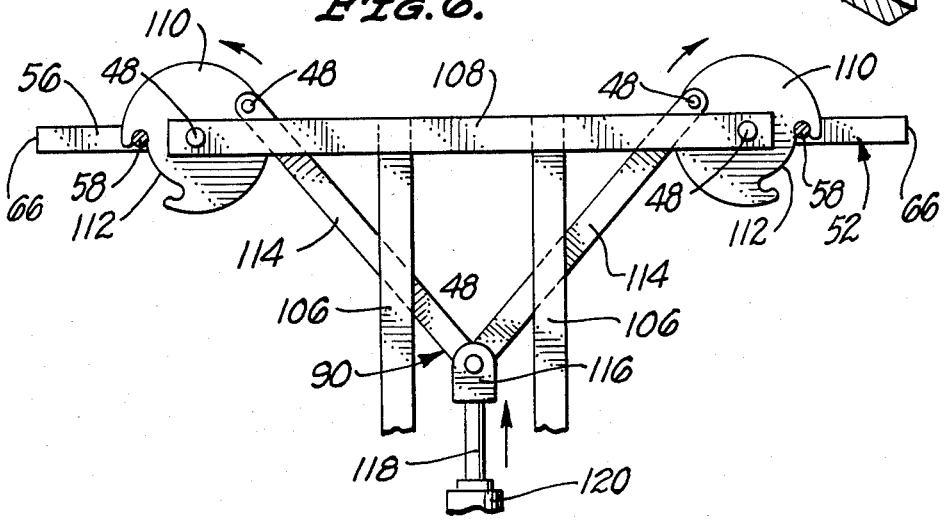

OPERABLE WALL

BACKGROUND OF THE INVENTION

The invention set forth in this specification pertains to new and improved operable walls. More specifically it pertains to operable wall structures in which panel sections may be mechanically manipulated into and out of a storage position.

As mechanical terms go the expression "operable wall" is a comparatively new term or expression. This term is now commonly utilized to designate vertically extending walls capable of being manipulated between "in use" and "storage" configurations or positions. These walls are normally composed of a series of wall sections or panels which are located so that the edges of these panels are immediately adjacent to one another so as to form a continuous or continuous appearing functional wall when the operable wall is in such an "in use" position. Most commonly, when the operable wall is in the "storage" position the panels are located in a stack so that the sides of the panels are immediately adjacent to one another.

In these operable walls the individual wall sections are normally supported by a track or track system located within a comparatively large structure on the ceiling or a similar part of the interior of a structure through the use of trolleys which engage the track system and which hold the wall panels or wall sections so that they hang vertically. In comparatively small operable wall structures it is commonplace for the individual wall sections to be secured together in a manner permitting pivotal or rotary motion between them along their side edges. Experience has determined that this is not particularly practical in connection with comparatively large operable walls. As a result of this, normally comparatively large wall sections are independently supported from the ceiling track or track system through the use of trolleys as indicated.

Most commonly, two different trolleys are used with each such wall section so as to avoid any problem of having to balance a wall section about a center support. Normally, the trolleys used in such structures are wheeled trolleys secured to the wall sections through the use of shafts so that the trolleys can be pivoted with respect to the wall sections. This permits the use of non-linear tracks to support the wall sections and may permit manipulation of them into a storage position.

In spite of the fact that there has been considerable development in the field of operable walls it is considered that operable walls using independently suspended wall sections as briefly indicated in the preceding discussion have not been as satisfactory as one would desire because of problems encountered in moving or manipulating these wall sections between "use" and "storage" positions as discussed in the preceding. The weight of comparatively large independently suspended wall sections makes it rather difficult to move them. This difficulty in moving them has particularly been encountered in manipulating comparatively large, heavy wall sections so that their trolleys go around curves or bends as they are moved into and out of storage positions as indicated in the preceding discussion. Further, when such wall sections are comparatively tall wall sections problems have been encountered as a result of the wall sections being pulled or turned out of a vertical position as efforts are made to move them with respect to other panels in order to form a stack in which the wall panels are in a face to face relationship.

BRIEF SUMMARY OF THE INVENTION

As a result of these considerations it is considered that it will be apparent that there is a need for new and improved operable walls. This invention is intended to fulfill this need. More specifically, it is intended to provide new and improved operable walls of a type having independently supported wall sections which may be easily and conveniently manufactured at a comparatively nominal cost and which may be easily and conveniently utilized without there being any significant danger of damage occurring as a result of the wall being pulled from a vertical orientation as these wall sections are manipulated between use and storage positions. This latter is particularly important in connection with comparatively large and/or comparatively heavy wall panels, and in particular in connection with comparatively tall, independently mounted wall sections.

In accordance with this invention these objectives are achieved by providing an operable wall for use beneath the ceiling of a building, said operable wall having a track system adapted to be mounted on said ceiling, said track system including a primary track and a set of at least two storage tracks, said storage track intersecting said primary track, said operable wall also having a series of wall sections, each of said sections including a wall panel having an upper end, a set of shafts extending upwardly from the upper end of each wall panel and a trolley means located on each of said shafts so as to be rotatable with respect thereto, said wall panels being vertically supported by said trolley means engaging tracks of said track system in which the improvement comprises:

said storage tracks being located parallel to one another; rotary switch means being located at the intersection of said primary track with the tracks of said sets of storage tracks, said trolley means on each of said wall sections being spaced with respect to one another so as to be capable of concurrently fitting within said rotary switch means and so as to be capable of concurrently fitting within said tracks of said set of storage tracks, said switch means being capable of being positioned so that trolley means located thereon may be either moved onto said tracks of said sets of storage tracks or along said primary track, actuator means for concurrently operating said switch means so that the trolley means located thereon will be concurrently positioned to either go onto said tracks of said set of storage tracks or onto said primary track, positioning means for supplying a force to move said wall sections between said switch means and said storage tracks and from said storage tracks to said switch means adapted to be located on said ceiling, and holding means for engaging said wall sections in order to temporarily secure then with respect to said positioning means so that during the operation of said positioning means the wall section can be moved between said primary track and said set of storage tracks and between said tracks of said storage tracks and said primary track.

BRIEF DESCRIPTION OF THE DRAWING

Because of the nature of this invention it is best more fully explained in reference to the accompanying drawings in which:

FIG. 1 is a partial isometric view of a part of an operable wall system in accordance with this invention;

FIGS. 5 and 6 are diagrammatic views showing the movements of certain parts of the operable wall shown in the preceding figures.

Figure 2:
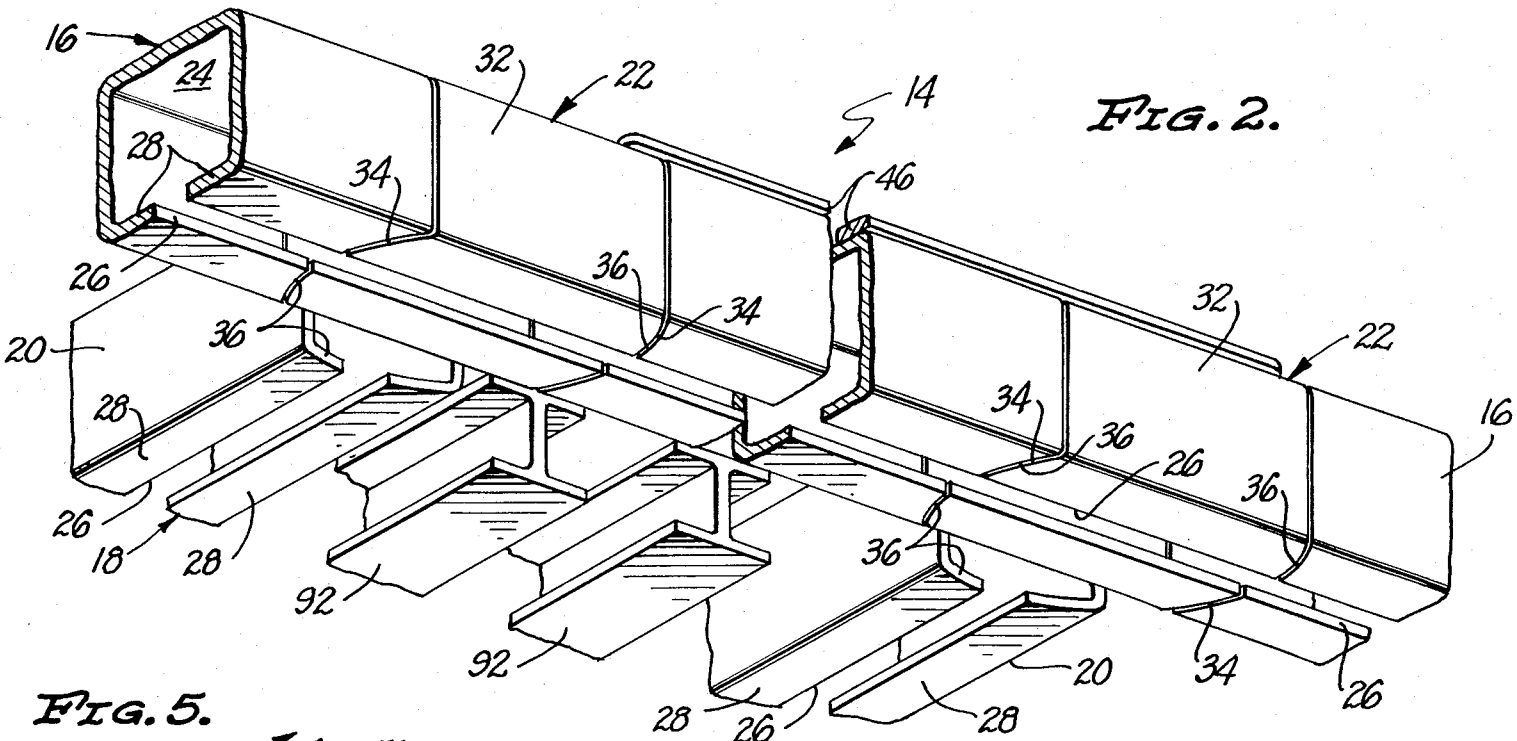
FIG. 2 is a partial isometric view at a different scale than FIG. 1 showing the orientation of the various tracks and switches used in the wall indicated in the preceding figure.
Figure 5:
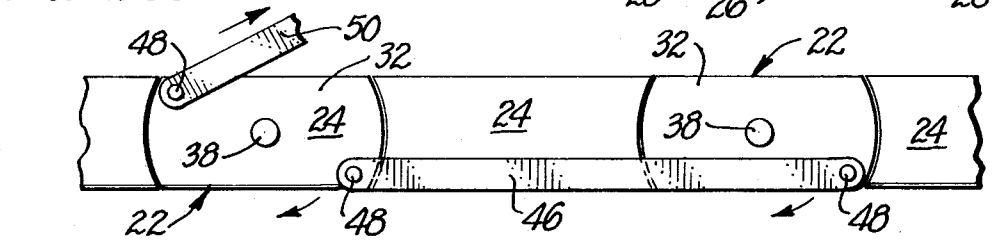

The accompanying drawings are primarily intended to illustrate in a diagrammatic manner a presently preferred usage of the operative concepts or principles of this invention set forth and defined in the appended claims. Thus, these drawings are not to be taken as illustrating any precise operable wall structure drawn to scale and are not to be taken as illustrating the exact way that the operative concepts or principles of this invention will be applied in a specific circumstance. It is considered probable that each newly designed installation of an operable wall of the present invention will differ from preceding operable walls utilizing the concepts of this invention as a result of a multitude of factors, including, without limitation, the availability of standard track hardware and other components and specific problems encountered in connection with an installation.

For these reasons the accompanying drawings are not to be considered as limiting the invention in any respect. Instead it is to be considered to be limited solely by the appended claims forming a part of this disclosure. It is considered possible to design a variety of differently appearing, somewhat differently constructed operative walls utilizing the principles or concepts set forth in these claims through the use of routine engineering skill.

DETAILED DESCRIPTION OF THE INVENTION

An operable wall or wall system 10 in accordance with the present invention is shown in the drawings. This wall system 10 is utilized beneath a conventional building ceiling 12. No effort is made to illustrate the building of which the ceiling 12 forms a part since the construction of such an edifice does not form a part of the present invention.

This wall system 10 includes a track system 14 as is best indicated in FIG. 2 of the drawings. The track system 14 includes a primary track 16 The primary track 16 will normally extend along the ceiling 12 in a linear pattern, although on occasion it may be curved slightly. This track system 14 also includes a set 18 of two parallel storage tracks 20 which, in the particular system 10, are located perpendicularly to the primary track 16 intermediate the ends (not shown) of this primary track 16 so as to intersect the primary track 16 in the sense that they are connected to the primary track 16 through the use of rotary switches 22.

The primary and storage tracks 16 and 20 in cross section appear as rectilinear tubes constructed so as to have a top wall 24 and a bottom elongated slot 26 located between bottom flanges 28. Normally, the top walls 24 will be connected to and spaced from the ceiling 12 a comparatively short distance by means of conventional spacers 30 (FIG. 3) so as to allow room for certain operative parts as hereinafter explained.

The switches 22 include switch sections 32 which have an identical cross sectional configuration to the the tracks 16 and 20 and which have curved ends 34 corresponding to ends 36 of a corresponding curvature on the tracks 16 and 20. These track sections 32 are supported for rotation about a vertically extending axis (not shown) through the use of central shafts 38 extending upwardly from the top walls 24 of the sections 32 so as to be carried by brackets 40 secured to the ceiling 12. Normally conventional washers 42 will be used between the brackets 40 and top walls 24 to facilitate rotation. If desired another type of bearing can be used.

The switch sections 32 are mounted in this way so that they may be rotated from the positions shown in the drawing in which they are aligned with and in effect form a part of the primary track 16 to positions in which they are aligned and in effect form a part of the storage tracks 20. When, as shown, the storage tracks 20 are located intermediate the ends (not shown) of the primary track 16 trolleys 44 as used with a wall system 10 may be rolled through these switch sections 32. If in a particular installation a primary track 16 is not extended past a particular wall switch 22 it is considered desirable to place a wall or other barricade (not shown) and an end 34 which in effect terminates the primary track 16 do as to prevent a trolley 34 from rolling through it.

The two switches 22 are connected by a link 46. This particular link 46 is pivotally attached to the top walls 24 of the two switch sections 34 by means of conventional pivot pins or shafts 48. As a result of these switches 22 being connected in this way it is possible to apply a force to one of the switches 22 through another link 50 in order to rotate them both in synchronism with one another. This link 50 is secured in place through a further pin 48. Other corresponding actuating means for rotating the two switches 32 in synchronism with one another can, of course, be used. If desired they can be independently rotated although this is not normally preferred.

The trolleys 44 indicated in the preceding discussion form a part of various wall sections 52 utilized in the complete wall system 10. These wall sections 52 in the system 10 are independent of one another in the sense that they are not connected to one another. Each of them includes a vertically extending wall panel 54. With the invention these panels 54 will normally be comparatively long, narrow, comparatively heavy panels constructed in various different known ways. At their upper ends 56 they carry elongated shafts 58 which extend vertically upwardly through the slots 26 and bearing openings 60 in the bodies 62 of the trolleys 44. These shafts 58 are secured against downward movement through the use of conventional nuts 64 or in other equivalent manners.

It will be noted that these shafts 58 extend parallel to one another and are spaced reasonably close to the side edges 66 of the wall sections 52. As used, they space the upper ends 56 below the track system 14 so as to allow room for various operative mechanisms as subsequently described and for a false ceiling 68 utilized to hide or cover the operative parts as hereinafter identified of the wall sections 52 other than the wall panels 54 and portions of the shafts 58 attached to them. This false ceiling 68 is provided with slots 70 which correspond to the slots 26 in the primary and storage tracks 18 except for the fact that they intersect as shown.

It is considered that it will be obvious that these slots 70 are for the purpose of accommodating movement of the shafts 58 as wall sections are moved from an operative position in which they are disposed along the primary track 16 in an edge to edge relationship in the manner in which the single wall section 52 illustrated toward the right of FIG. 1 is disposed vertically beneath the primary track 16 to a storage position in which individual wall sections 52 are located with the panels 54 in face to face relationship with their side edges 66 next to one another beneath the storage tracks 20. In the storage position the wall section 52 can be referred to as being stacked. Several of these wall sections 52 are indicated towards the left of FIG. 1 in a storage position.

In order to get these wall sections 52 from an in use to a storage position each section is individually pulled or pushed generally in the direction of the primary track 16 so that the wheels 72 supported by axles 74 on the bodies 62 of its trolleys 44 roll along the bottom flanges 28 of the primary track 16. As a result of such movement a wall section 52 will be moved from the primary track 16 so that its trolleys 44 are located within the switch sections 32 of the two switches 24.

If desired, a small bump-like riser or cam 76 may be located along the bottom flanges 28 in the switch sections 32 in order to provide a tactile sensation that the trolleys 44 are in place in the switches 22. Other mechanical equivalents can of course be substituted for the risers 76, The use of such a mechanical means to determine if the trolleys 44 are correctly positioned within the switches 22 is quite desirable in preventing the possibility of damage resulting from the operation of the switches 22 when the trolleys 44 are not properly positioned.

Figure 3:
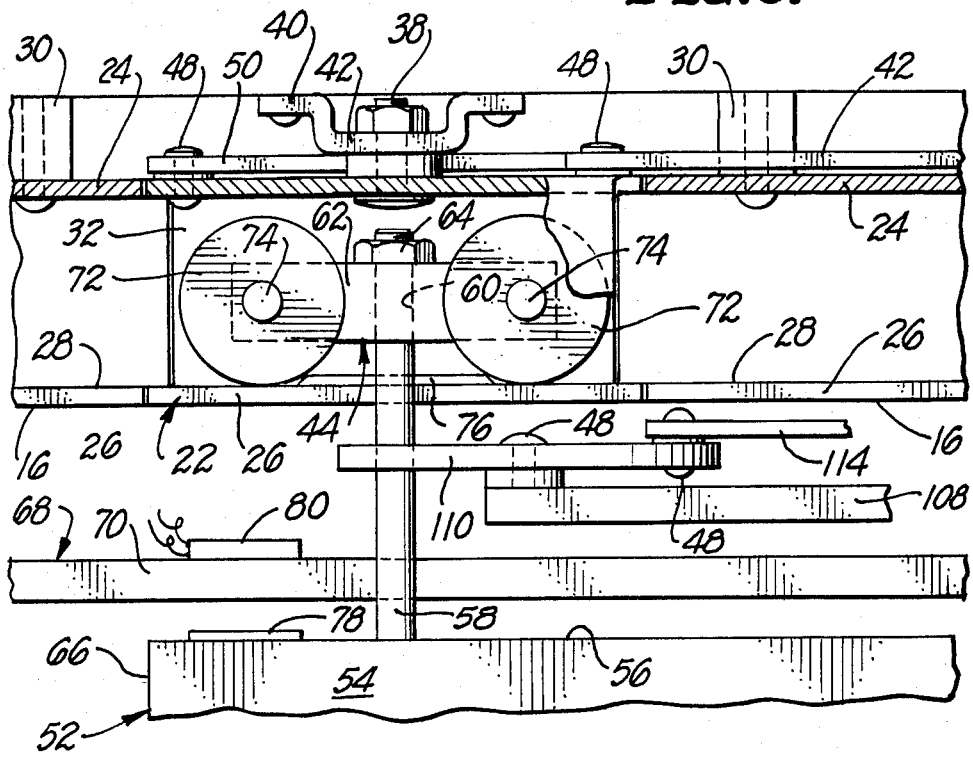
FIG. 3 is a partial cross section view at another scale taken at line 3—3 of FIG. 1.
Figure 4:
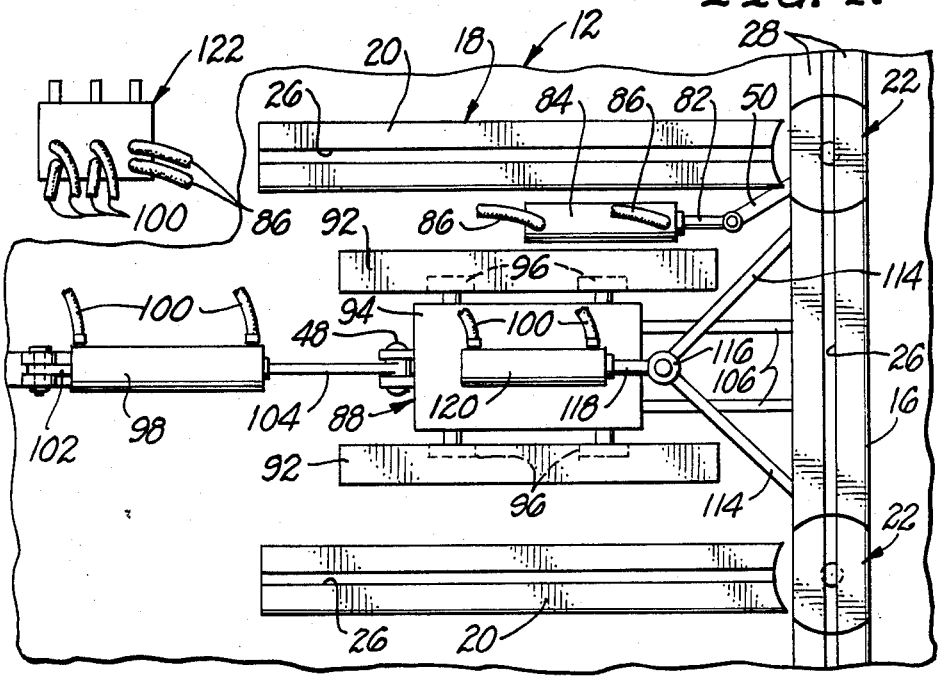
FIG. 4 is a diagrammatic plan view looking up showing the relationship between certain parts of an operable wall as herein described.

If desired, other means could be used to determine if the trolleys 44 are correctly located. Thus, for example as illustrated in FIG. 3 it is possible to utilize a small iron plate or small conductive plate 78 on a wall panel 54 and to detect the presence of this plate through an appropriate switch such as a Hall effect switch 80 mounted upon the false ceiling 68.

In any event, when the trolleys 44 of a particular wall section 52 have been moved from the primary track 16 onto the switches 22 these switches may be rotated so that the track sections 32 are aligned with the storage tracks 20 by applying a force to the link 50 previously described. In the particular structure illustrated this link 50 is connected to a piston rod 82 of a double acting pneumatic cylinder 84 which, for convenience of illstration, is shown as being mounted upon the ceiling 12.

The use of a pneumatic cylinder 84 is preferred because pressure of the gas supplied to the cylinder 84 through hoses 86 make it possible to avoid or minimize damage in the event there should be some mechanical intereference with the operation of the switches 22. Preferably, the cylinder 84 and the rod 82 are of such a dimension so that the switch sections 32 can only be rotated between being aligned with the primary track 14 and the storage tracks 20. However, if this is not reasonably convenient conventional stops (not shown) can be employed in order to limit the rotation of these sections 32.

It will be realized that when the switches 22 are rotated after a wall section 54 has been wheeled on to them from the primary track 16 that the trolleys 44 upon this particular wall section 52 will be twisted or rotated as a result of contact with the interior of the switch sections 32 so as to be aligned with these sections these trolleys 44 will then be capable of being rolled off of the switch sections 32 on to the storage tracks 20. In the past in related structures the wall sections 52 associated with such trolleys have been moved in this manner by applying physical force to their wall panels 54.

As indicated in the Background of the Invention section of this specification it has been comparatively difficult to cause such movement and, further, the wall sections 52 have frequently been moved somewhat out from the vertical in causing such movement. it will be realized that such movement out of the vertical is quite apt to cause damage, particularly because of the coverage involved in connection with the movement of comparatively long, tall wall sections 52. With the present invention this type of problem is eliminated.

It is eliminated through the use of what is referred to herein as a "positioning means" 88 and what is referred to herein as a "holding means" 90. The positioning means 88 includes a pair of parallel rails 92 which are mounted directly upon the ceiling 12 and a small carriage 94 which is adapted to ride upon these rails 92 through the use of wheels 96. This carriage 94 is adapted to be moved through the use of another pneumatic cylinder 98 supplied with pnuematic fluid through the use of conventional hoses 100. An end 102 of the cylinder 98 may be secured directly to the ceiling 12 while a piston rod 104 extending from the cylinder 98 is secured in a conventional manner through another pin 48 to the carriage 94. With this arrangement it will be quite apparent that the carriage can be reciprocated along the rails 92.

This carriage 94 is provided with extensions 106 which in turn support a cross bar 108. Disks 110 are secured to this cross bar 108 through the use of further pivot pins 48. These disks 110 are provided with double ended peripheral notches 112. The disks 110 are adapted to be rotated in synchronism with one another through the use of links 114 secured to them through further pins 48 which connect these disks 110 with a yoke 116 on a piston rod 118 carried by another pneumatic cylinder 120. This cylinder 120 is mounted upon the carriage 94 so as to move therewith. It is connected to other flexible hoses 100 so that it can be operated in a conventional manner.

The various hoses 100 previously indicated are preferably connected to a conventional control 122 which, in the interest of brevity, is shown in the drawing as a box having a series of levers (not numbered) extending therefrom. This control 122 is connected to the cylinder 84 through other hoses 100 so as to be capable of operating the switches 22 and is connected to the cylinder 98 so as to be capable of reciprocating the carriage 94 and to the cylinder 120 so as to be capable of rotating the disks 108.

When the wall system 10 is used to store the wall sections 52 from an in use position on the track 16 normally the control 122 will be operated to withdraw the carriage 94 from adjacent to the switches 22 and an individual walll section 52 will be rolled onto these switches. Next they will be rotated through the operation of the cylinder 84.

After the switches 22 have been so rotated the control 122 will be operated so as to move the carriage 94 toward the track 16.

Normally the cylinder 120 will then be operated so as to concurrently rotate both of the disks 110 in such a manner as to "hook" the notches 112 generally in engagement with the shafts 58 in the manner indicated in FIG. 6. At this point further rotation will normally be stopped as a result of the comparatively low pneumatic pressure applied to the cylinder 120. As soon as the shafts 58 are engaged in this manner the cylinder 98 will next be operated so as to move the carriage 94 generally away from the primary track 16.

As this occurs, forces will be applied through the disk 110 to the shafts 58 which will pull the wall section 52 of which these shafts form a part so that its trolleys 94 roll into and along the storage tracks 20. This movement will continue until it is deliberately stopped through the operation of the cylinder 120 or until the wall section 52 moves in the manner reaches closed off ends (not shown) of the storage tracks 20 or other stop mechanisms of a similar character (not shown) or until this particular wall section 52 is moved so that its panel 54 lies adjacent to another panel 54.

At this point the normally used comparatively low pneumatic pressure will result in all further movement caused by the cylinder 98 being stopped. When this is noticed the control 112 will normally be actuated so as to stop any flow of fluid which might cause further movement of the carriage 94 and so as to rotate the disks 110 out of contact with the shafts 58. Next the switches 22 will be returned to their position in alignment with the primary track 16 by the operation of the control 122 so as to in turn operate the cylinder 84.

This will normally be followed by another wall section 52 being rolled into place on the switches 22. Then the cylinder 98 will be operated so as to move the carriage 94 through the use of the cylinder 120 back to the position in which the disks 110 may be rotated so as to engage the shafts 58 on the newly positioned wall section 52. Then the sequence of operation indicated in the preceding can be repeated. As a result of this a series of the wall sections may be easily stored.

These wall sections 52 may just as easily be replaced upon the primary track 16 be essentially the reverse of the various operations indicated in the preceding. In such replacement the switches 22 will be rotated so as to be capable of receiving the trolleys 44 of a wall section 52 from the storage tracks 20. Next the carriage 94 will be positioned so that the disks 110 can be rotated to engage the shafts 58 on the wall section 52 closest adjacent the primary track 16.

It will be noted that the double ended notches 112 permit this utilization. The engagement of the shafts 58 of the particular wall section 52 noted will be followed by the movement of the carriage 94 so as to place this particular wall section 52 so that its trolleys 44 are in the switch sections 32. The switches 22 may then be rotated so as to line up with the primary track 16. This will normally be followed by rotation of the disks 110 so as to release a wall section 52 held by the switches 22. If desired this last sequence of two operations may be reversed.

The latter operation will be followed by withdrawal of the carriage 94. After a particular wall section 52 is moved from the storage track 20 on the switches 22 and after the switches 22 have been aligned with the primary track 16 this particular wall section 52 can, of course, be rolled to an in use position along the primary track 16.

I claim:

1. An operable wall for use beneath the ceiling of a building, said operable wall having a track system including a primary track and a set of at least two storage tracks, said storage track intersecting said primary track, said operable wall also having a series of wall sections including a wall panel having an upper end, a set of shafts extending upwardly from the upper end of each wall panel and a trolley means located on each of said shafts so as to be rotatable with respect thereto, said wall panels being vertically supported by said trolley means engaging tracks of said track system in which the improvement comprises:

said storage tracks being located parallel to one another, rotary switch means being located at the intersection of said primary track with the tracks of said sets of storage tracks, said trolley means on each of said wall sections being spaced with respect to one another so as to be capable of concurrently fitting within said rotary switch means and so as to be capable of concurrently fitting within said tracks of said set of storage tracks, said switch means being capable of being positioned so that trolley means located thereon may be either moved onto said tracks of said set of storage tracks or along said primary track, actuator means for concurrently operating said switch means so that the trolley means located thereon will concurrently be positioned to either go onto said tracks of said set of storage tracks or onto said primary track, positioning means for supplying a force to move said wall sections between said switch means and said storage tracks and from said storage tracks to said switch means adapted to be located on said ceiling, said positioning means comprises a carriage mounted so as to be capable of being moved parallel to said storage tracks and means for moving said carriage toward and away from said primary track, holding means for engaging said wall sections in order to temporarily secure them with respect to said positioning means so that during the operation of said positioning means the wall section can be moved between said primary track and said set of storage tracks and between said tracks of said storgae tracks and said primary track, said holding means are mounted on said carriage and extend therefrom into engagement with the one of said wall sections being moved at any one time so as to hold said section so that it moved as said carriage is moved, and said holding means include members mounted on said carriage for engaging the shafts of a wall section to be moved so as to engage said shaft during the movement of said carriage.

2. An operable wall as claimed in claim 1 wherein:

said holding means include pneumatic cylinder means for causing engagement of said shafts.

3. An operable wall as claimed in claim 2 wherein:

said holding means include notched disks mounted on said carriage and means for rotating said notched disks so that the notches therein engage the shafts of the wall section to be moved.

4. An operable wall as claimed in claim 3 wherein:

said means for rotating said disks include a pneumatic cylinder connected to said disks.

5. An operable wall for use beneath the ceiling of a building, said operable wall having a track system including a primary track and a set of at least two storage tracks, said storage track intersecting said primary track, said operable wall also having a series of wall sections including a wall panel having an upper end, a set of shafts extending upwardly from the upper end of each wall panel and a trolley means located on each of said shafts so as to be rotatable with respect thereto, said wall panels being vertically supported by said trolley means engaging tracks tracks of said track system in which the improvement comprises:

said storage tracks being located parallel to one another, rotary switch means being located at the intersection of said primary track with the tracks of said sets of storage tracks, said trolley means on each of said wall sections being spaced with respect to one another so as to be capable of concurrently fitting within said rotary switch means and so as to be capable of concurrently fitting within said tracks of said set of storage tracks, said switch means being capable of being positioned so that trolley means located thereon may be either moved onto said tracks of said set of storage tracks or along said primary track, actuator means for concurrently operating said switch means so that the trolley means located thereon will concurrently be positioned to either go onto said tracks of said set of storage tracks or onto said primary track, positioning means for supplying a force to move said wall sections between said switch means and said storage tracks and from said storage tracks to said switch means adapted to be located on said ceiling, said positioning means comprise a carriage mounted so as to be capable of being moved parallel to said storage tracks and means for moving said carriage toward and away from said primary track, holding means for engaging said wall sections in order to temporarily secure them with respect to said positioning means so that during the operation of said positioning means the wall section can be moved between said primary track and said set of storage tracks and between said tracks of said storgae tracks and said primary track, said holding means are mounted on said carriage and extend therefrom into engagement with the one of said wall sections being moved at any one time so as to hold said section so that it moves as said carriage is moved, said actuator means includes link means connecting said switch means so as to cause said switch means to rotate in synchronism to one another, and hydraulic cylinder means connected to one of said switch means for rotating one of said switches, such rotation of said one of said switches being transmitted to the other of said switch means through said link means.

6. An operable wall as claimed in claim 5 wherein:

said positioning means comprises a carriage mounted so as to be capable of being moved parallel to said storage tracks and means for moving said carriage toward and away from said primary track, said holding means include members mounted on said carriage for engaging the shafts of a wall section to be moved so as to engage said shafts during the movement of said carriage, said holding means include pneumatic cylinder means for causing engagement of said shafts.

7. An operable wall as claimed in claim 6 wherein:

said holding means include notched disks mounted on said carriage and means for rotating said notched disks so that the notches therein engage the shafts of the wall section to be moved, said means for rotating said disks include a pneumatic cylinder connected to said disks.

* * * * *